US006195956B1

(12) United States Patent
Reyneveld

(10) Patent No.: US 6,195,956 B1
(45) Date of Patent: Mar. 6, 2001

(54) CONCRETE FORM

(76) Inventor: Willy J. Reyneveld, 2911 Landco Ave., Bakersfield, CA (US) 93308

( * ) Notice: Subject to any disclaimer, the term of this patent is extended or adjusted under 35 U.S.C. 154(b) by 0 days.

(21) Appl. No.: 09/220,798

(22) Filed: Dec. 28, 1998

(51) Int. Cl.[7] ..... E04G 21/00; B28B 11/12
(52) U.S. Cl. ..... 52/745.19; 264/163
(58) Field of Search ..... 249/2, 3, 4, 6, 249/5, 8, 9, 97, 117, 139, 167, 168, 169, 165, 160, 163; 52/720.1, 731.2, 732.1, 102, 745.2; 264/138, 163

(56) References Cited

U.S. PATENT DOCUMENTS

| | | | | |
|---|---|---|---|---|
| 1,682,008 | | 8/1928 | Heltzel . | |
| 3,907,624 | * | 9/1975 | Gravely, Jr. | 264/138 |
| 4,060,217 | | 11/1977 | Kirk . | |
| 4,101,111 | | 7/1978 | Bishop . | |
| 4,365,455 | * | 12/1982 | Braine | 264/35 |
| 4,389,831 | * | 6/1983 | Baumann | 264/35 |
| 4,494,725 | | 1/1985 | Sims . | |
| 4,702,640 | * | 10/1987 | Allen | 404/75 |
| 4,846,437 | | 7/1989 | Fitzgerald . | |
| 5,494,373 | * | 2/1996 | Amon | 404/82 |
| 5,609,005 | * | 3/1997 | Schierloh et al. | 264/35 |
| 5,771,643 | * | 6/1998 | Parker | 404/8 |

* cited by examiner

*Primary Examiner*—Michael Safavi
(74) *Attorney, Agent, or Firm*—Nixon & Vanderhye P.C.

(57) ABSTRACT

A process for pouring and finishing a concrete slab having a predetermined thickness. Concrete forms are arranged to define the periphery of the slab. Each form having a recessed top wall which serves to provide a support area for a temporary extended border portion of the slab with the border portion having a thickness less than the predetermined thickness of the slab. Concrete is poured within the area defined by the forms to a height determined by the upper edge of the form. The temporary extended border portion of the slab being supported by the recessed top wall. The concrete slab is surface finished across the top surface thereof, extending outwardly at least to the inner most portion of the temporary extended border portion of the slab. After the concrete has hardened, the forms are removed along with the temporary extended border portion as by cutting through the concrete along an inner vertical surface of the concrete forms.

2 Claims, 4 Drawing Sheets

CONCRETE FORM

TECHNICAL FIELD

This invention relates to forms used to define the edges of a concrete platform, slab or the like, and which are generally removed after the concrete has set.

BACKGROUND

Traditionally, to define a perimeter of a given area to be poured with concrete, a "form board" or perimeter-stopping system using temporary forms is installed. One such temporary form is made of two inch thick (lumber dimension) boards, the widths of which correspond to the thickness of the slab desired, i.e., a four inch thick slab requires 2"×4" boards, and a six inch thick slab requires 2"×6" boards, etc. The boards are temporarily installed with forming stakes about the edges of the slab. The top edge of the boards is then set to the desired slab height (i.e., slab thickness) by laser beam or other appropriate site instrument. The concrete is then poured using the top edge of the perimeter forms as a reference. One disadvantage of this system, however, is that conventional concrete surface finishing machines are only able to finish within about six inches of the slab edge. As a result, the outer borders of the slab must be surface finished manually at considerable time and expense.

SUMMARY OF THE INVENTION

The product and process of this invention seeks to perform the same function as the above described traditional concrete form system, but with significantly less labor and greater accuracy. The new process involves basically moving the edges of the slab to a point six to eight inches beyond the actual desired perimeter edge. The unique concrete form in accordance with this invention allows the concrete to be placed on top of the form to a depth of about 1 to about 1½ inches, and six to eight inches beyond the desired perimeter edge of the slab. This extended border that is supported on the form becomes a temporary extended border which is disposable along with form. After the concrete is poured, a conventional surface finish machine is employed such to surface finish within about six to eight inches of the temporary extended edge, but at least to the actual desired perimeter edge. After the concrete has sufficiently hardened, a saw cut is made at the actual desired perimeter edge, through the reduced thickness border extension, and the form and along with the border extension are removed.

The concrete form in accordance with this invention may be made with any suitable but relatively inexpensive material, for example, corrugated laminated cardboard, plastic, metal or the like. The form is substantially box-like in shape, with a laterally outwardly extending flange which facilitates nailing or spiking of the form to the ground to hold the form in place about the perimeter of the slab to be poured. The form has an upper surface flush with an upper edge of one side wall but recessed relative to an upper edge of an opposite side wall to thereby provide a support for the temporary extended border of the slab. In addition, smooth dowel or stakes may be used in conjunction with the form to assist primarily in temporarily holding the form retention to the concrete after the concrete has been poured.

In a preferred arrangement, the form may include a rigid foam block which has a height dimension less than a corresponding predetermined thickness for the concrete slab to be poured. The foam block supports on its upper surface, a plastic angle plate including a horizontal portion seated on the upper surface of the foam block, and a vertical edge portion which defines the temporary extended border of the slab. The combined height of the foam block and the vertical plastic edge corresponds to the predetermined thickness of the slab. In this embodiment, the form can be anchored to the crown by one or more spikes driven through the plastic plate and the foam block, with the spike also serving to hold the plastic plate to the foam block.

Accordingly, in its broader aspects, the present invention relates to a concrete form having a first wall defining a height dimension corresponding to a predetermined thickness and a peripheral edge of a concrete slab, and a second wall transverse to the first wall for supporting a temporary extended border portion of the slab, the temporary extended border portion having a thickness less than the predetermined thickness of the slab and such that an upper surface of the slab including the temporary extended border portion is substantially flat and continuous.

In another aspect, the invention relates to a process for pouring and finishing a concrete slab having at least one peripheral edge and a predetermined thickness, the process comprising:

a) providing one or more concrete forms in an arrangement defining a periphery of the slab, the form having a recessed top wall providing a support area for a temporary extended border portion of the slab having a thickness less than the predetermined thickness;

b) pouring the concrete within the area defined by the form to a height determined by an upper edge of the form, and so that the temporary extended portion of the slab is supported on the recessed top wall;

c) surface finishing the concrete slab across the top surface thereof, extending outwardly at least to the innermost portion of the temporary extended border portion of the slab; and d) after the concrete has hardened, removing the form along with the temporary extended border portion.

Additional objects and advantages of the invention will become apparent from the detailed description which follows.

DETAILED DESCRIPTION OF THE DRAWINGS

Figure 1:
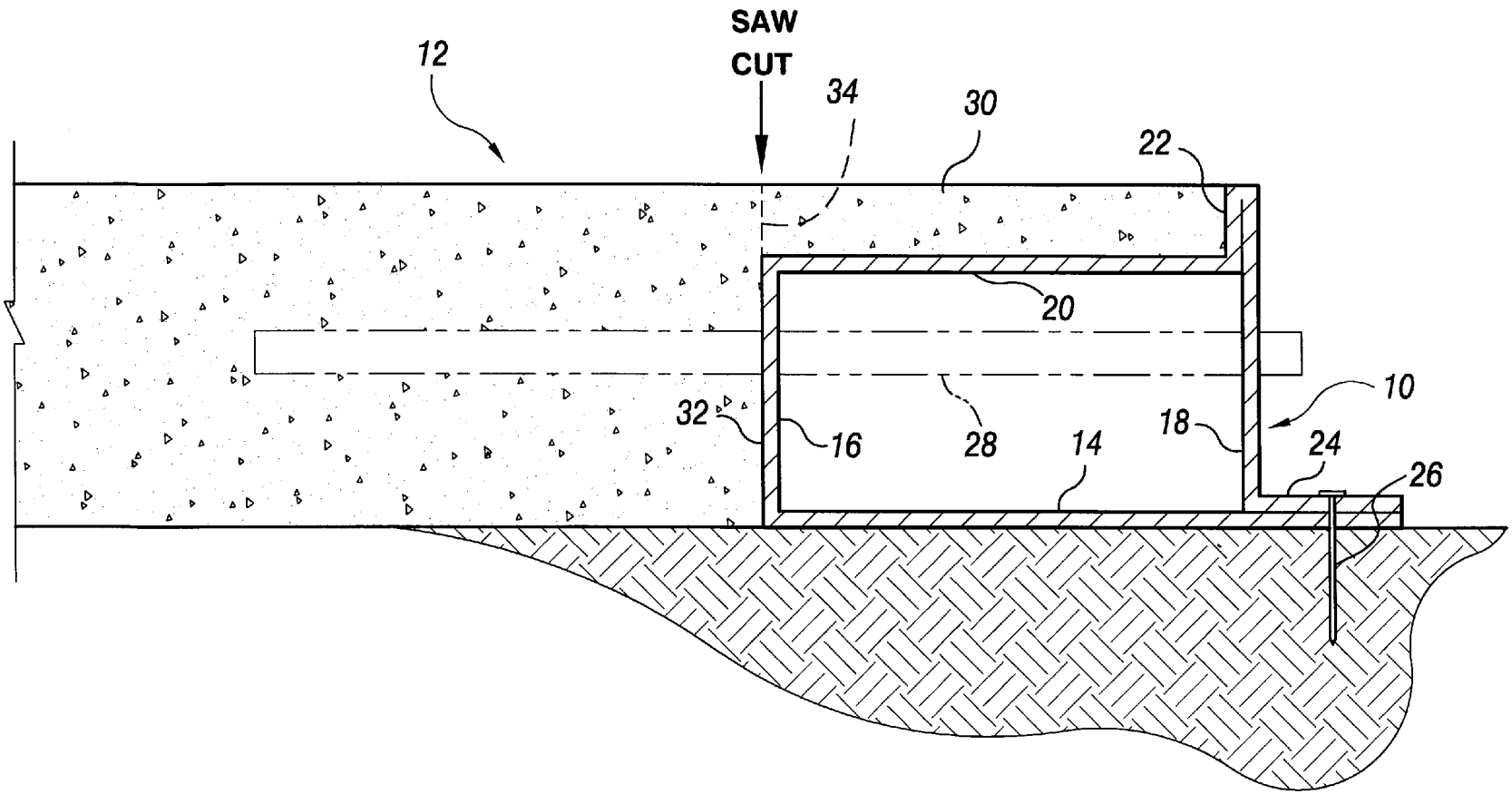
FIG. 1 is a partial side section view illustrating the concrete form construction in accordance with this invention secured in place and after pouring of a concrete slab.
Figure 2:
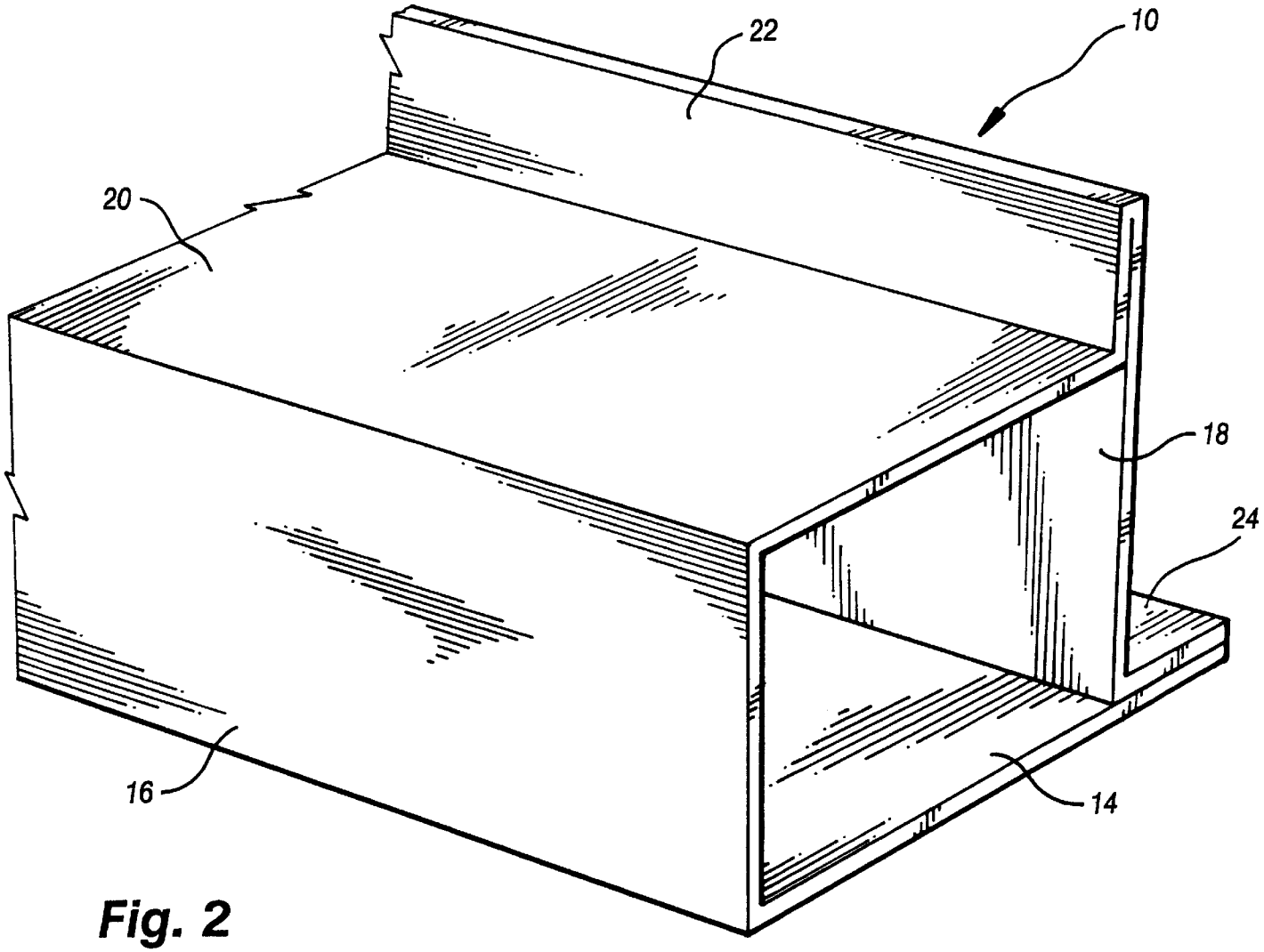
FIG. 2 is a perspective view of a portion of the form similar to that illustrated in FIG. 1, but shown in isolation.

With reference now to FIGS. 1 and 2, the concrete form 10 in accordance with this invention is intended to be utilized in the pouring of a concrete slab 12. The slab may be square or rectangular, or any other shape but preferably (but not necessarily limited to) one which has a periphery defined by straight sides.

The concrete form 10 is preferably made of corrugated cardboard which may have laminations on opposite sides of the type disclosed in U.S. Pat. No. 5,670,238. Other suitable materials (e.g., plastic, metal, wood, etc.) may be employed, but it is advantageous if the materials are relatively inexpensive and easy to manufacture. The form 10 includes a base 14, a pair of side walls 16, 18, and an upper wall 20, thereby forming a hollow, box-like shape. The upper wall 20, however, is recessed relative to the height of side wall 18 by means of a substantially vertical folded back portion 22 of the side wall 18. Side wall 18 also includes a horizontal bottom flange 24 which overlaps a portion of the base 14 and which is utilized to anchor the form to the ground by means of one or more spikes or nails 26. The surface 20 is flush with the upper edge of side wall 16, so as to provide a support for an extended concrete border portion as described further below. A smooth dowel 28 (having a length of, for example, 18 inches or longer) may be inserted through the form 10 as shown in FIG. 1 so as to extend into the concrete pouring area in order to align and retain the form 10 along one side of the slab, as the concrete is poured and as it hardens.

With the form 10 in place as shown in FIG. 1, the concrete is poured to form slab 12 with a thickness of, e.g., six inches, and with a temporary extended border portion 30 supported on the top wall 20 of the form 10, the height or thickness of which corresponds to the height of the folded back portion 22 of wall 18, e.g., one to one and one half inches. Thus, the portion 30 which extends between side wall 16 and side wall 18 forms the temporary border portion, which extends laterally six to eight inches beyond the desired and ultimate slab edge, as defined by the outer surface 32 of side wall 16. The upper surface of the extended border is flush or continuous with the upper surface of the remaining area of the slab.

A conventional surface finishing machine may be used to surface finish the slab, recognizing that the machine, even when guided along wall portion 22, can only surface finish the concrete along a line parallel to wall portion 22, and extending in general alignment with the surface 32. Then, a saw cut is made as shown at 34, through the reduced thickness of the extended border portion 30, i.e., the cut need only extend downwardly as far as top wall 20. The form can then simply be pulled or knocked away from the edge of the slab, and away from the dowel 28. The dowel can thereafter be cut so as to present a smooth straight surface along the edge of the slab.

If the concrete slab 12 is formed with four straight sides, then it will be appreciated that four forms 10 would be employed, with the above process carried out sequentially or simultaneously about the sides of the slab. It will be appreciated, however, that the form length, width and height may be varied to suit particular applications, and the form may present straight or curved edge defining surfaces as well.

By extending the slab 12 at a reduced thickness along the top wall 20 of the form, a conventional concrete surface finishing machine can surface finish the slab 12 at least out to the desired peripheral edge of the slab. As a result, when the form and the extended border portion 30 of the concrete are removed, the slab is in fact surface finished to the edge 30, thereby eliminating manual surface finishing of the peripheral portion of the slab resulting from the inability of present concrete surface finishing machines to surface finish all the way to the edge of the slab.

Figure 3:
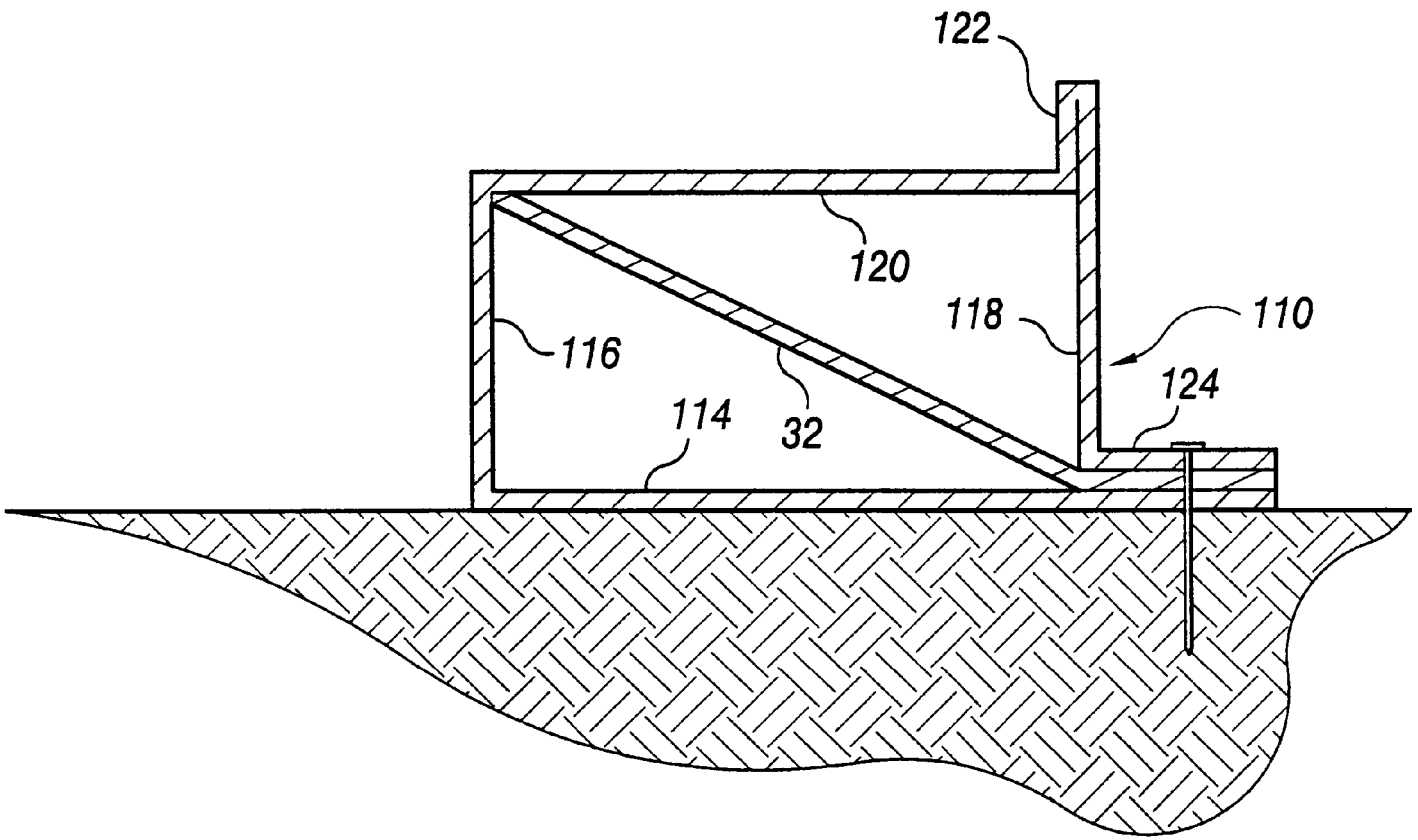
FIG. 3 is a side section view of a variation of the forms shown in FIGS. 1 and 2, but anchored to the ground and prior to concrete pouring.

In a modified embodiment of the invention as shown in FIG. 3, the form 110 is similar to form 10 shown in FIGS. 1 and 2 with the exception that a diagonal brace 36 is utilized to further strengthen the form, one end of the brace 36 sandwiched between flange 124 and bottom wall 114. The use of a dowel 28 is optional.

Figure 4:
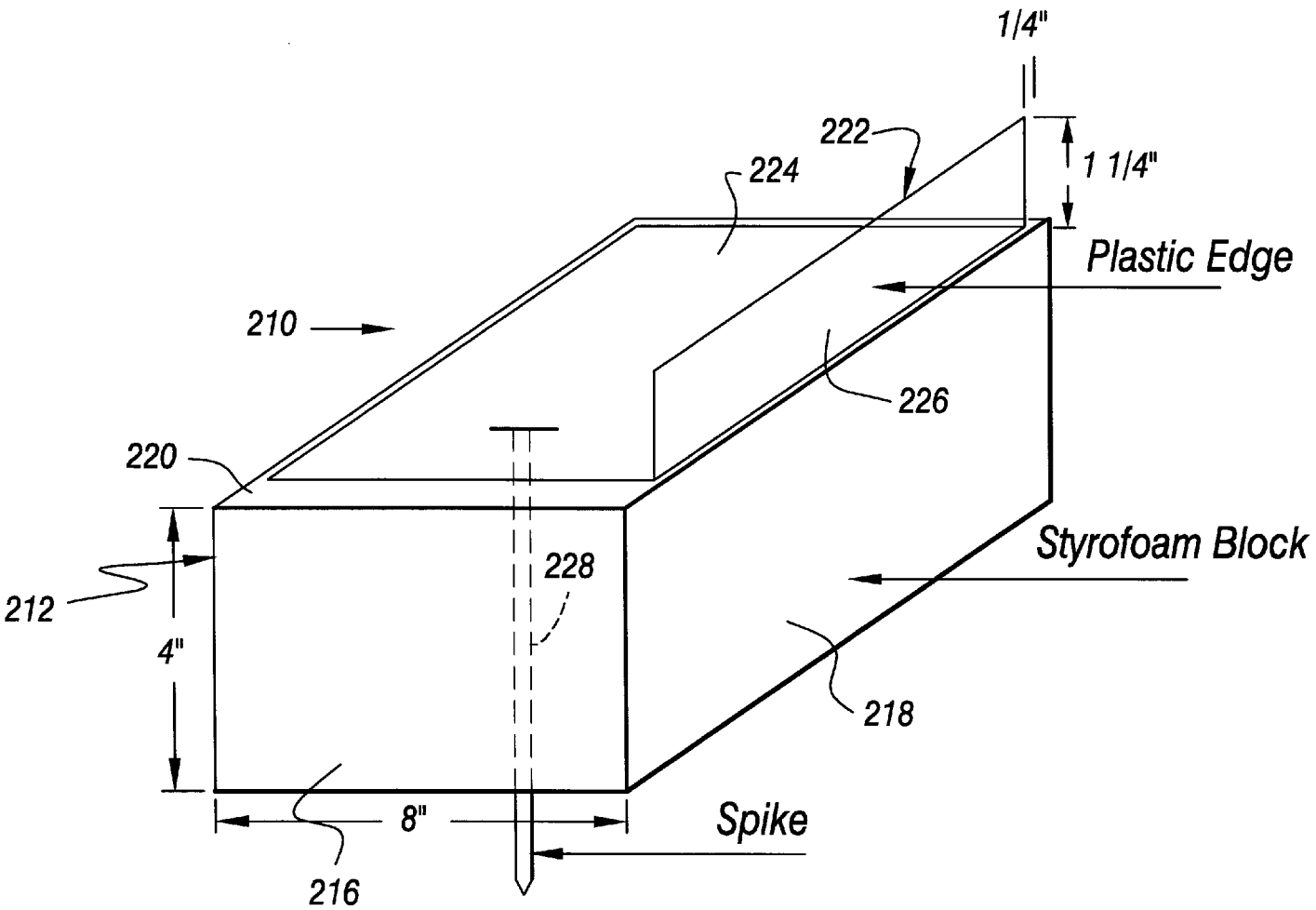
FIG. 4 is a perspective view of a preferred embodiment of the invention.

With reference now to FIG. 4, a presently preferred embodiment of the invention is illustrated. Here, the concrete form 210 is constructed of a rigid foam block 212 having opposite side surfaces (one of which is shown at 216), and opposite front and back surfaces (only the back surface 218 is shown), and an upper surface 220. The height of the block 212 is less than a predetermined height for the thickness of the slab to be poured. A plastic angle plate 222 is seated on the upper surface 220 of the foam block. This component includes a horizontal plate portion 224 and a vertical edge portion 226, the latter defining the outside edge of the extended border portion of the slab. It will be noted that the combined height of the foam block and the height of the vertical edge 226 together correspond to the predetermined thickness of the slab to be poured. One or more spikes 228 can be driven through the horizontal plate portion 224 and the block 212 for the purpose of anchoring the form to the ground. The spike also serves to hold the plastic angle plate 222 relative to the foam block.

The manner in which the concrete form illustrated in FIG. 4 is used is similar to that described above in connection with FIG. 1. Thus, after the concrete form has been poured, with a temporary extended portion supported on the plastic plate 222, the concrete is surface finished utilizing a conventional surface finishing machine. Then, a saw cut is made similar to that described above in connection with cut 34. Thereafter, the form can be separated from the slab, removing the temporary extended border portion along with it.

It will also be appreciated that a dowel similar to dowel 28 may be employed with this preferred embodiment of the form. In addition, it will be appreciated that the length of the form will be dictated by the slab length.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for pouring and finishing a concrete slab having at least one peripheral edge and a predetermined thickness, the process comprising:

a) providing one or more concrete forms in an arrangement defining a periphery of the slab, the form having a recessed top wall providing a support area for a temporary extended border portion of the slab having a thickness less than said predetermined thickness;

b) pouring the concrete within the area defined by the form to a height determined by an upper edge of the form, and so that the temporary extended border portion of the slab is supported on the recessed top wall;

c) surface finishing the concrete slab across the top surface thereof, extending outwardly at least to the innermost portion of the temporary extended border portion of the slab; and d) after the concrete has hardened, removing the form along with the temporary extended border portion.

2. The process of claim 1 wherein step a) is carried out such that an upper surface of the slab including the temporary extended border portion is substantially flat and continuous.

* * * * *